US007670267B2

(12) United States Patent
Wang

(10) Patent No.: US 7,670,267 B2
(45) Date of Patent: Mar. 2, 2010

(54) PACE-ADJUSTING MECHANISM OF AN ELLIPTICAL CROSS TRAINER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/895,103

(22) Filed: Aug. 24, 2007

(65) Prior Publication Data

US 2009/0054212 A1 Feb. 26, 2009

(51) Int. Cl.
*A63B 22/04* (2006.01)
*A63B 24/00* (2006.01)

(52) U.S. Cl. ..... 482/52; 482/57

(58) Field of Classification Search ..... 482/51–53, 482/57, 70, 79–80

See application file for complete search history.

(56) References Cited

U.S. PATENT DOCUMENTS

| | | | | |
|---|---|---|---|---|
| 6,361,476 | B1 * | 3/2002 | Eschenbach | 482/52 |
| 7,267,638 | B2 * | 9/2007 | Wang | 482/52 |
| 2007/0238580 | A1 * | 10/2007 | Wang | 482/52 |

* cited by examiner

*Primary Examiner*—Steve R Crow

(57) ABSTRACT

A pace-adjusting mechanism of an elliptical cross trainer having an electric adjusting motor installed at the bottom of a flywheel transmission unit for driving a telescopic tube in displacement. Meanwhile, a w-shaped driven connecting rod and two L-shaped connecting elements are employed to adjust the vertical position of two treadle planks, thereby achieving different exercise paces.

1 Claim, 3 Drawing Sheets

PACE-ADJUSTING MECHANISM OF AN ELLIPTICAL CROSS TRAINER

BACKGROUND OF THE INVENTION

1. Fields of the Invention

The invention relates to a pace-adjusting mechanism of an elliptical cross trainer, and more particularly, to a mechanism that can rapidly adjust the movement pace at will.

2. Description of the Related Art

The elliptical cross trainer is so used that the operator's feet can make an elliptical movement path, thereby simulating the real running and walking path. Moreover, the horizontal pace (simulating the movement on a flat ground) and the inclined pace (simulating the uphill and downhill movement) can be changed when the vertical position of the treadles of the elliptical cross trainer changes. This is the main intention of the invention.

U.S. Pat. No. 6,090,013 discloses such a mechanism that employs a plurality of selection holes in treadle planks. By selecting a desired hole in the treadle plank for connection, the coupling angle of the treadle plank can be changed to achieve the above-mentioned pace-adjusting effect.

In fact, the manual adjustment of the aforementioned prior art is not a practical solution. This is because the operator has to stop the exercise for adjustment of the movement pace, thereby reducing the desire of using the elliptical cross trainer. Meanwhile, this adjustment way must affect the exercise rhythm. Thus, it is hardly possible to use the pace-adjusting mechanism during the exercise sessions so that this kind of the pace-adjusting mechanism is not so practical and valuable as expected.

SUMMARY OF THE INVENTION

It is a primary object of the invention is to provide a pace-adjusting mechanism of an elliptical cross trainer that employs an electric adjusting mechanism instead of a manual adjusting mechanism. In this way, the operator can easily perform a desired adjustment during the exercise session without stopping the exercise and affecting the movement rhythm. Accordingly, the pace-adjusting mechanism of an elliptical cross trainer can be easily and practically used.

According to the invention, an electric adjusting motor is employed to drive a telescopic tube for creating a change of the supporting angle of a w-shaped driven connecting rod pivotally coupled to the frame unit. Meanwhile, an L-shaped connecting element pivotally coupled to the treadle plank is employed for adjusting the position of the treadles and changing the movement pace.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
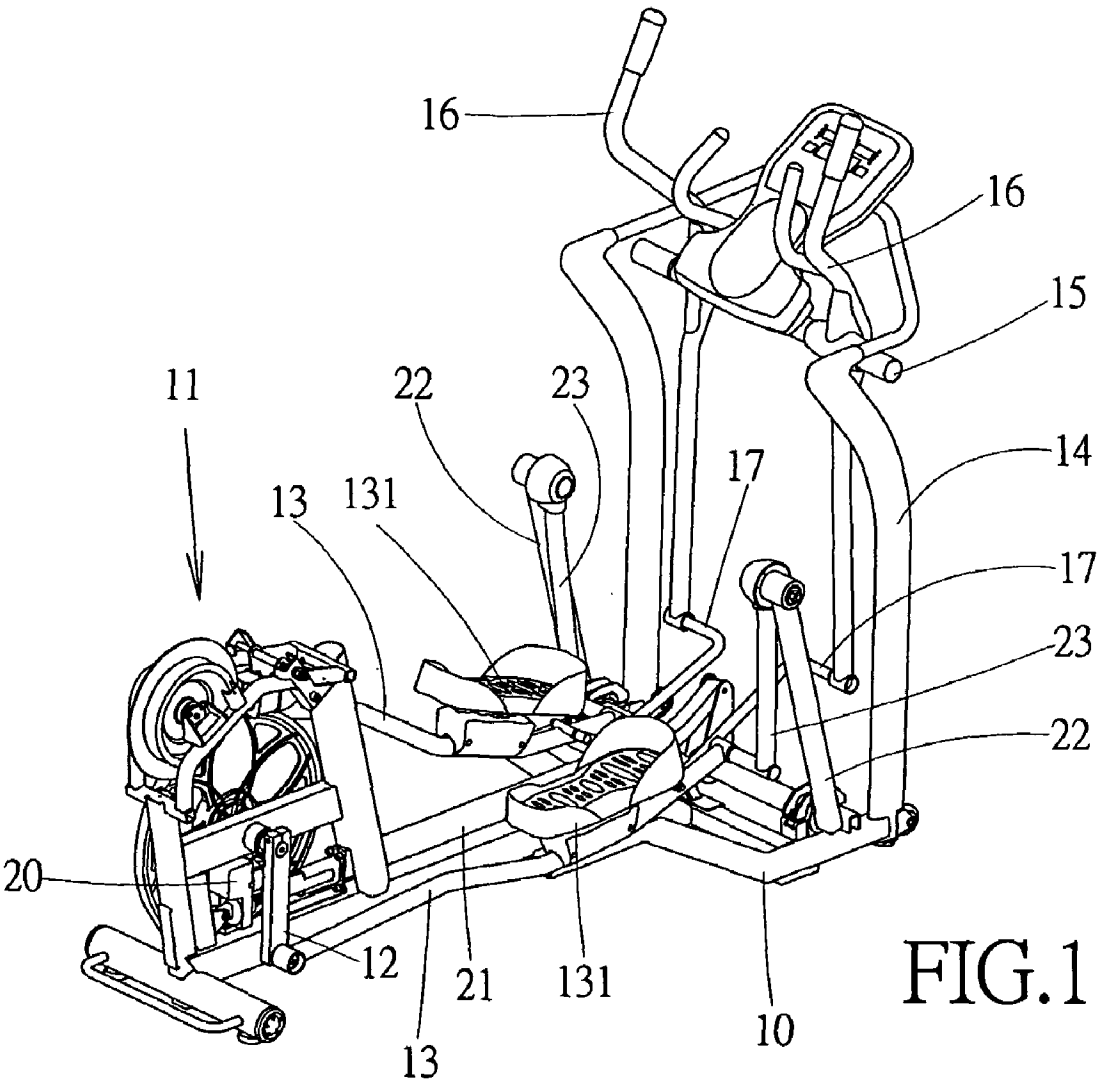
FIG. 1 is a perspective view of a preferred embodiment of the invention.
Figure 2:
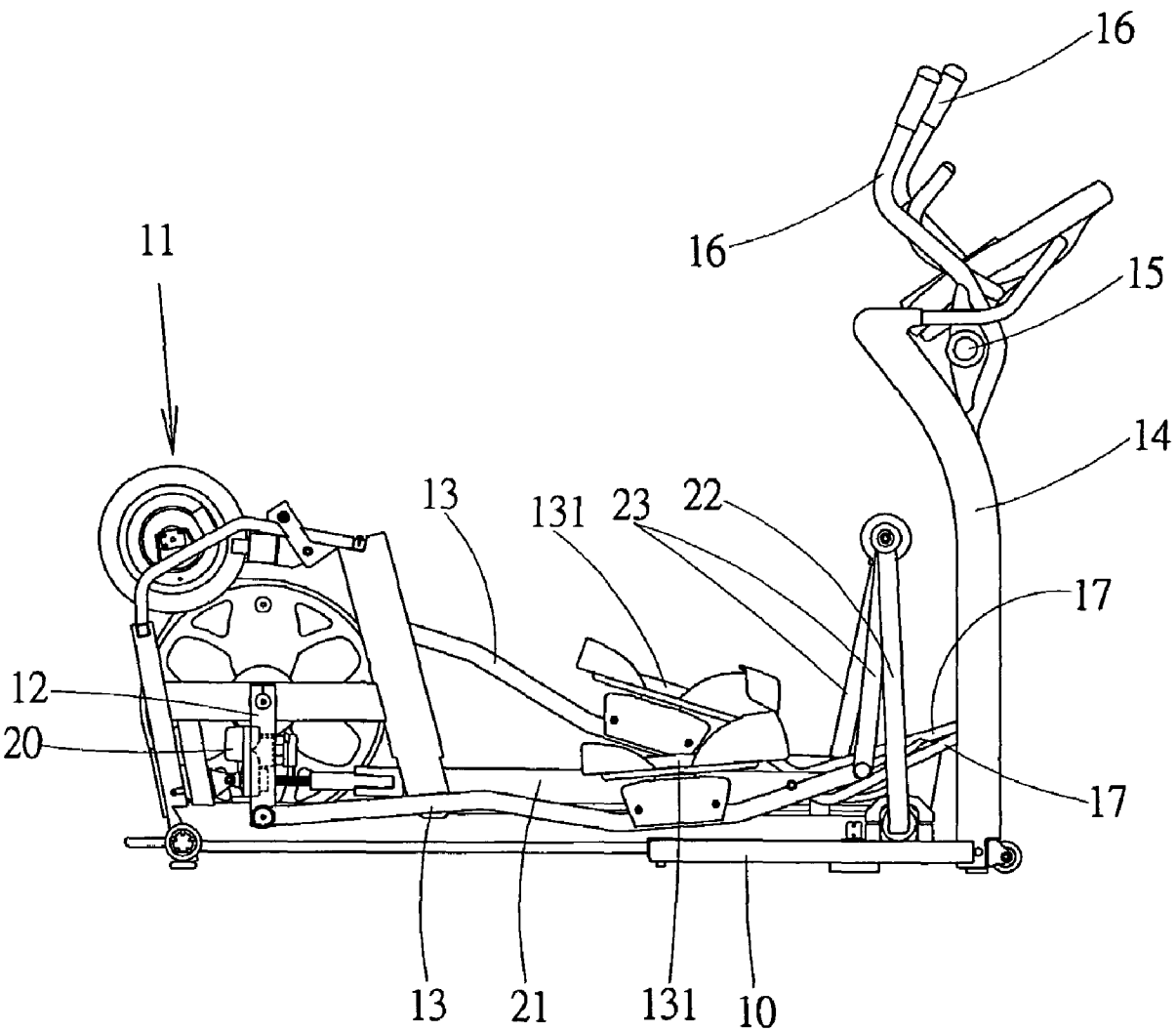
FIG. 2 is a side view of the embodiment of FIG. 1.

Referring to FIGS. 1 and 2, a preferred embodiment of the invention includes a frame unit 10 und an electric adjusting motor 20.

The frame unit 10 has a rear end on which a flywheel transmission unit 11 is placed. The flywheel transmission unit includes a crank 12 at both sides thereof that is pivotally coupled to a corresponding treadle plank 13. The elliptical cross trainer has two upright posts 14 at the front end thereof between which a cross bar 15 is extended. Two handles 16 are pivotally attached to the cross bar 15. A bend 17 is pivotally coupled to a bottom end of the handles 16, respectively. Moreover, the opposing end of the bend 17 is pivotally coupled to a bottom end near the front section of the treadle plank 13. In this way, the components are coupled in such a way that they can be synchronically moved.

The electric adjusting motor 20 is installed at the bottom of the flywheel transmission unit 11 for driving a telescopic tube 21 in a shift movement. The vertical position of the two treadle planks 13 is adjustable by two connecting rods 22 and two L-shaped connecting elements 23, each connecting rod 22 being pivotally connected to a respective L-shaped connecting element 23.

Figure 3:
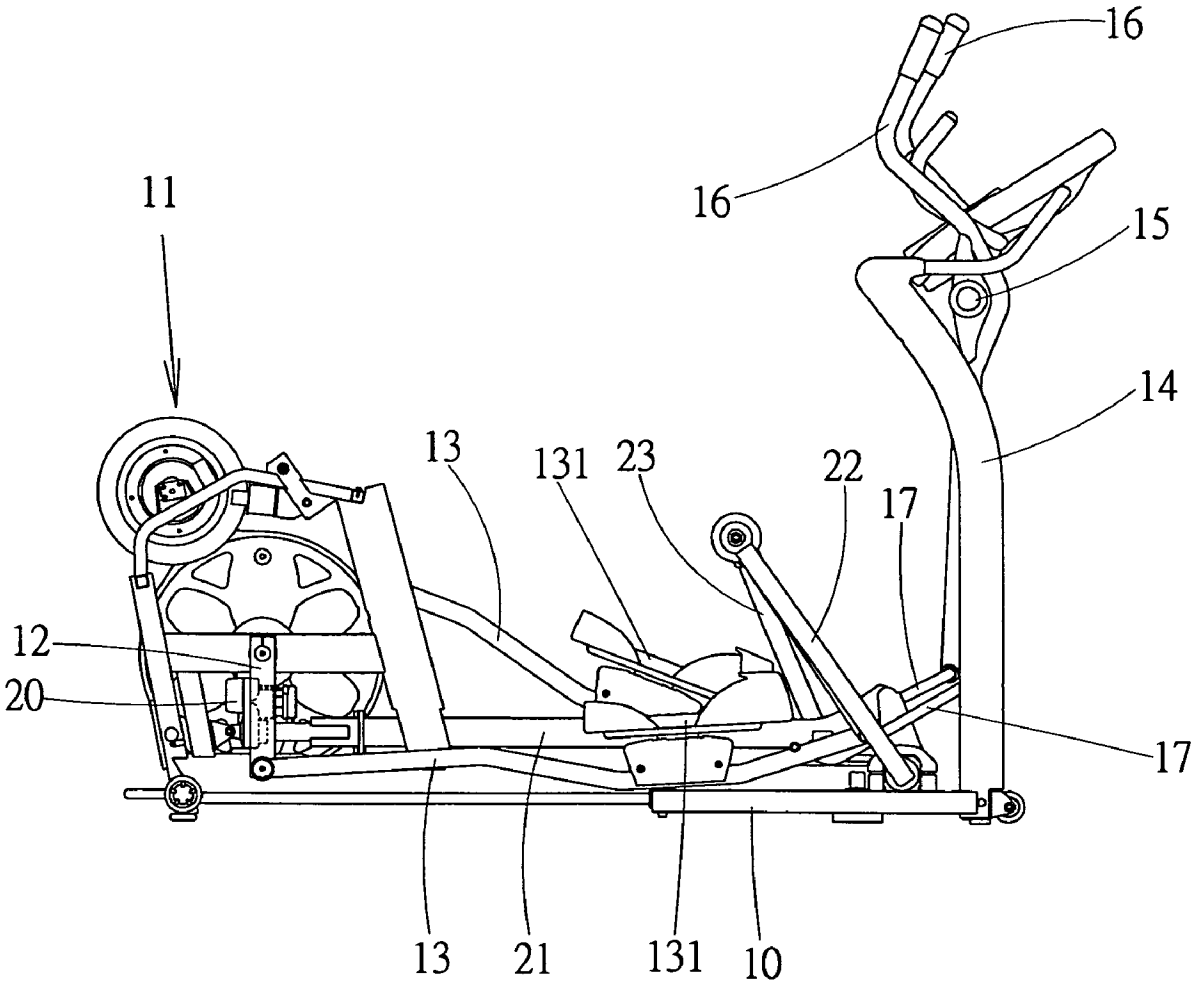
FIG. 3 is a side view of the embodiment of FIG. 2 after adjustment.

As shown in FIGS. 2 and 3, when the telescopic tube 21 is driven by the motor 20 to create a reciprocating in-place displacement thereof, it results in a change of the supporting angle of the connecting rod 22. In this way, the vertical position of the treadle plank 13 and the treadle 131 thereon can be adjusted by the coupling relationship of the two connecting rods 23. Accordingly, different exercise paces can be achieved.

Many changes and modifications in the above-described embodiment of the invention can, of course, be carried out without departing from the scope thereof Accordingly, to promote the progress in science and the useful arts, the invention is disclosed and is intended to be limited only by the scope of the appended claim.

What is claimed is:

1. An elliptical cross trainer having a pace-adjusting mechanism, comprising:

a) a frame unit having a rear end;

b) a flywheel transmission unit placed on the frame unit;

c) a crank located at both sides of the flywheel transmission unit;

d) a corresponding treadle plank pivotally coupled to the crank, the elliptical cross trainer having two upright posts at the front end thereof between which a cross bar is extended, two handles being pivotally attached to the cross bar, a bend being pivotally coupled to a bottom end of the handles, respectively, the opposing end of the bend being pivotally coupled to a bottom end near the front section of the treadle plank so that the aforementioned components are coupled in such a way that they can be synchronically moved;

e) an electric adjusting motor installed at the bottom of the flywheel transmission unit;

f) a telescopic tube driven by the motor to elongate and retract;

g) two connecting rods;

h) two separate L-shaped connecting elements, each respective L-shaped connecting element pivotally connected to each connecting rod, to adjust the vertical position of the two treadle planks; and wherein, when the telescopic tube is driven by the motor to create a reciprocating in-place displacement thereof, a change of the supporting angle of each of the two connecting rods such that the vertical position of the treadle plank and the treadle thereon is adjusted by the coupling relationship of the two connecting rods, thereby achieving different exercise paces.

* * * * *